US005181554A

United States Patent [19]

Mita

[11] Patent Number: 5,181,554

[45] Date of Patent: Jan. 26, 1993

[54] RADIATOR COOLING APPARATUS FOR AN AUTOMOBILE ENGINE

[75] Inventor: Yoshiyuki Mita, Shizuoka, Japan

[73] Assignee: Usui Kokusai Sangyo Kaisha Ltd., Shizuoka, Japan

[21] Appl. No.: 661,535

[22] Filed: Feb. 27, 1991

[30] Foreign Application Priority Data

Feb. 28, 1990 [JP] Japan ..... 2-45642

[51] Int. Cl.[5] ..... F01P 7/10

[52] U.S. Cl. ..... 165/41; 165/51; 165/123; 165/903; 165/44; 123/41.48; 123/41.49

[58] Field of Search ..... 165/121, 122, 123, 903, 165/119, 41, 44, 51; 237/12.3 A, 12.3 R; 123/41.48, 41.11, 41.49

[56] References Cited

U.S. PATENT DOCUMENTS

| | | | |
|---|---|---|---|
| 1,389,749 | 9/1921 | Froberg | 165/119 |
| 1,820,091 | 8/1931 | Reavis | 237/123 R |
| 1,976,959 | 10/1934 | Mueller | 165/123 |
| 2,015,643 | 9/1935 | Schmidt | 237/123 A |
| 2,191,519 | 2/1940 | Cornell, Jr. | 165/123 |
| 2,808,237 | 10/1957 | Fosnes | 165/903 |
| 2,879,040 | 3/1959 | McInnes | 165/121 |
| 3,183,968 | 5/1965 | Jekat | 165/123 |
| 3,194,307 | 7/1965 | Wood | 165/123 |
| 3,473,006 | 10/1969 | Barbier | 165/123 |
| 4,712,611 | 12/1987 | Witzel | 165/122 |
| 4,890,598 | 1/1990 | Kinsworthy | 165/123 |

FOREIGN PATENT DOCUMENTS

| | | | |
|---|---|---|---|
| 1045623 | 12/1958 | France | 165/123 |
| 54-158150 | 11/1979 | Japan . | |
| 821123 | 8/1957 | United Kingdom | 165/123 |
| 1436697 | 5/1975 | United Kingdom | 165/123 |

*Primary Examiner*—John K. Ford
*Attorney, Agent, or Firm*—Wenderoth, Lind & Ponack

[57] ABSTRACT

A radiator cooling apparatus for an automotive internal combustion engine is provided. The apparatus comprises an air suction duct or air injection duct connected to a closed-type blower. The suction duct draws ambient air through the core of the radiator and cools the hot water in the core. The injection duct injects ambient air toward the core and cools the hot water in the core. On the active surface of the duct, a plurality of bellmouths or nozzles are formed. The existing fan is removed from the engine, whereby fan noise is eliminated.

9 Claims, 3 Drawing Sheets

RADIATOR COOLING APPARATUS FOR AN AUTOMOBILE ENGINE

BACKGROUND OF THE INVENTION

This invention relates to a radiator cooling apparatus for an internal combustion engine, especially for an automotive engine, equipped with a water circulating radiator system.

In a conventional radiator cooling system, a fan is attached to a fan hub of the engine by means of bolts, and is driven by the engine. A powerful airflow is produced by the fan, and the airflow passes through the core of the radiator, along the direction from the fan to the core or from the core to the fan depending upon the type of the fan. Therefore, the fan itself is indispensable to the radiator cooling system.

Since the conventional fan is open to the atmosphere, great noise is emitted around the fan. This noise constitutes the greatest part of the engine noise.

Around the periphery of a fan, a fan shroud is usually mounted in order to guide and promote the airflow produced by the fan. From a view point of reducing the fan noise, the fan shroud is not very effective.

Japanese utility model public disclosure No. 158150/1979 discloses a soundproof cover isolating the engine from the atmosphere. A cooling fan for the engine is disposed outside of the cover and is driven by an electrical motor. However, this fan is open to the atmosphere and without soundproofing means.

From another point of view, a conventional fan has a disadvantage in that it leads to an enlargement of the total length of the engine, because the fan is situated at the distal end of the engine. In particular, when the engine is mounted on such a car as a so-called front-engine front-drive type, in which the engine is laid laterally to the centerline of the car, the total length of the engine becomes a matter of great concern.

SUMMARY OF THE INVENTION

It is an object of the present invention to reduce the noise produced by an engine.

Another object of the present invention is to lessen the total length of an engine.

Still another object of the present invention is to provide flexibility of the radiator arrangement in favor of free choices in car design.

According to one aspect of the invention, the existing fan is removed from the engine and an air suction duct is substituted for the fan. This air suction duct is disposed adjacent the core of the radiator, and a closed-type blower is connected to the suction duct.

In a preferred embodiment of the invention, the suction duct comprises a rectangular body. An active surface of the body faces the core of the radiator. A plurality of bellmouths are formed on the active surface.

With the results of the invention, the existing fan is removed, whereby the fan noise is eliminated. Instead, a closedtype blower is included. Thus, the greatest part of the engine noise is transformed into a small noise of the blower. Since the blower can be mounted in an appropriate position, the noise can be controlled to be kept at a minimum.

The removal of the fan leads to a reduction of the total length of the engine. This provides considerable flexibility in the radiator arrangement and the car design.

According to another aspect of the invention, the existing fan is removed from the engine and an air injection duct is substituted for the fan. This air injection duct is disposed adjacent the core of the radiator, and a closed-type blower is connected to the injection duct.

In a preferred embodiment of the invention, the injection duct comprises a rectangular body. An active surface of the body faces the core of the radiator. A plurality of nozzles are formed on the active surface.

The injection duct is advantageous for heavy use of the radiator. When it is applied to the radiator of off-road vehicles, the injection nozzles can prevent the radiator core from being blocked by sand or other particles.

When the engine is cloated at the downstream side of the air-flow from the injection nozzles, the engine housing, accessories, exhaust manifolds and the engine compartment are also cooled by the cooling air.

Other features and advantages of the invention will become apparent from a reading of the specification when taken in conjunction with the drawings, in which like reference numerals refer to like elements in the several views.

DESCRIPTION OF THE PREFERRED EMBODIMENT

Figure 1:
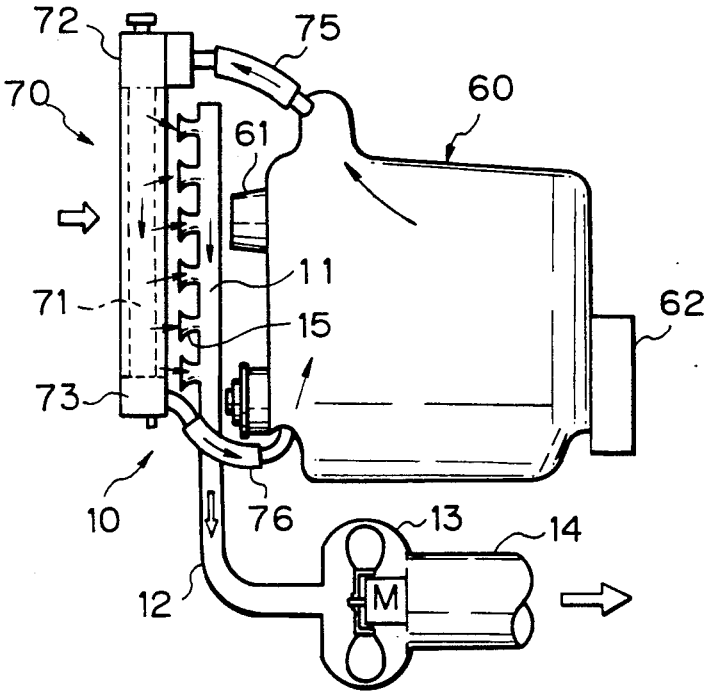
FIG. 1 is a schematic elevational view, partly in section, illustrating an arrangement of a radiator cooling apparatus according to the present invention.

Referring to FIG. 1, there is shown a first arrangement of the radiator cooling apparatus 10 of the present invention, associated with an internal combustion engine 60 and a radiator 70. The radiator 70 is a conventional type of main radiator having a core 71, which consists of a plurality of fins and small tubes, an upper tank 72 and a lower tank 73. Hot water from the engine 60 flows into the upper tank 72 by way of a rubber hose 75. While the hot water flows down through the core 71, it is cooled by a heat exchanging operation between the hot water and cooling air, and resultant cooled water flows into the lower tank 73. Then, the cooled water in the lower tank 73 flows into the engine 60 by way of a rubber hose 76.

Based upon the present invention, no fan is attached to the fan hub 61 of the engine 60. Instead, an air flow duct, in FIG. 1 an air suction duct 11, is installed adjacent the core 71 of the radiator 70. This suction duct 11 is connected to a closed-type (enclosed) blower 13 by way of a curved tube 12. The blower 13 is driven by an electric motor.

As the blower 13 is energized by the motor, ambient air is drawn through the core 71, providing heat exchanging effects. Thus, the hot water inside of the core 71 is cooled.

Exhaust air from the blower 13 flows out through a tube 14 into the ambient atmosphere. It is also possible to direct the exhaust air toward another heat exchanger or similar unit for further reutilization.

Upon the active surface of the suction duct 11, a plurality of air conduits or passages, in FIG. 1 bellmouths 15, are formed in order to promote the suction effects of air.

Figure 2:
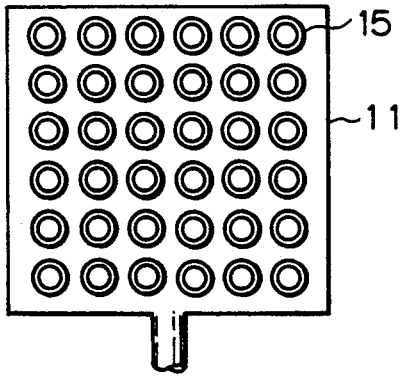
FIG. 2 is a side elevational view of the air suction duct of FIG. 1.

FIG. 2 illustrates a rectangular body of the suction duct 11 having opposite rectangular surfaces defining a hollow interior. A plurality of the bellmouths 15 are formed on the active surface and uniformly distributed. The configuration of the suction duct 11 may be varied depending upon the configuration of the radiator. The rectangular body of the suction duct 11 is substantially the same size as the radiator 70.

The blower 13 is not restricted to the electric motor driven type. It can be driven by the engine itself by means of an accessory driving mechanism, including a belt and a pulley.

In FIG. 1, the rear end of the suction duct 11 stands in close proximity with the fan hub 61 so as to reduce the total length of the engine 60 with the radiator 70, that is the length between the front edge of the radiator 70 and the rear edge of the flywheel housing 62. However, in such a case where the engine is laid laterally to a centerline of a car, it is not necessary to install the suction duct 11 closely to the fan hub 61. Rather, it is preferable to dispose the suction duct 11 remote from the engine 60. Since the fan is removed from the engine 60, the radiator 70 can be also disposed remote from the engine 60. Thus, in this case, the total length of the engine becomes the length of the engine housing itself. It should be understood that a reduction of the total length of the engine renders considerable flexibility in car design.

Figure 3:
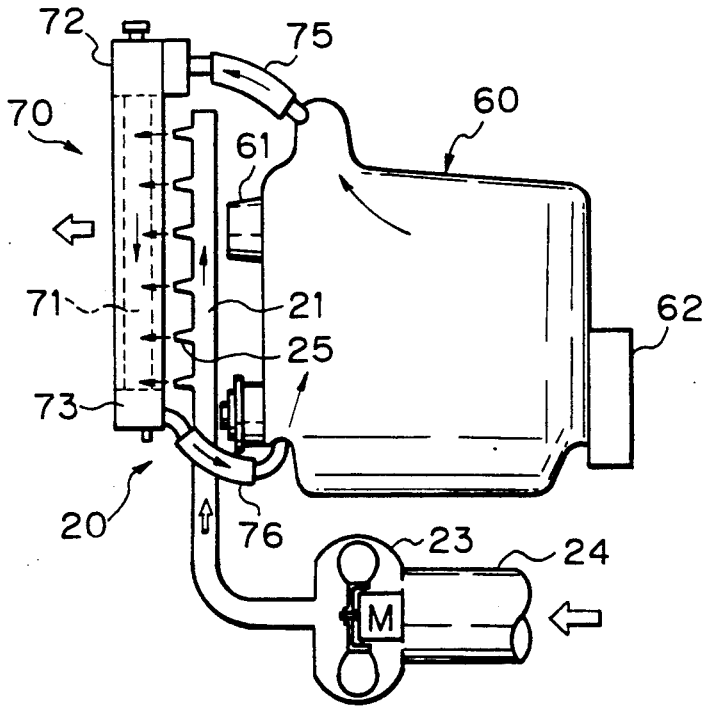
FIG. 3 is a schematic elevational view of a second embodiment of the invention.

FIG. 3 illustrates a second embodiment of the invention. In this radiator cooling apparatus 20, an air injection duct 21 is substituted for the suction duct 11 of FIG. 1. A closedtype electric motor 23 draws ambient air through a tube 24 and supplies it toward the injection duct 21. The air is injected from nozzles 25 formed on the active surface of the injection duct 21 toward the core 71 of the radiator 70. Thus, the hot water in the core 71 is effectively cooled.

As mentioned above, in a case where the engine is laid laterally to a centerline of a car, it is rather preferable to install the injection duct 21 remote from the engine for the purpose of providing flexibility in car design.

Figure 4:
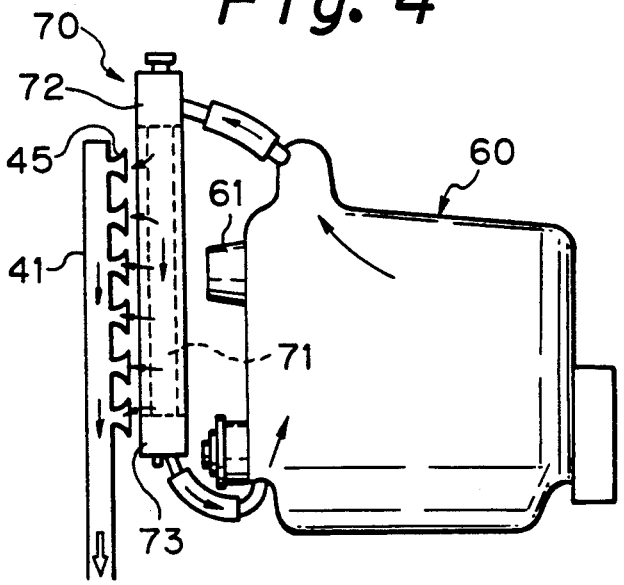
FIG. 4 is a schematic elevational view of a third embodiment of the invention.

FIG. 4 illustrates a third embodiment of the invention. In this radiator cooling apparatus, an air suction duct 41 is installed outside of the engine 60 relative to the radiator 70. On the active surface of the suction duct are formed, a plurality of bellmouths 45 as shown in FIGS. 1 and 2. It should be understood that, depending upon a designer's choice, the air suction duct can be positioned between the radiator and the engine housing (FIG. 1) or outside of the engine (FIG. 4).

Figure 5:
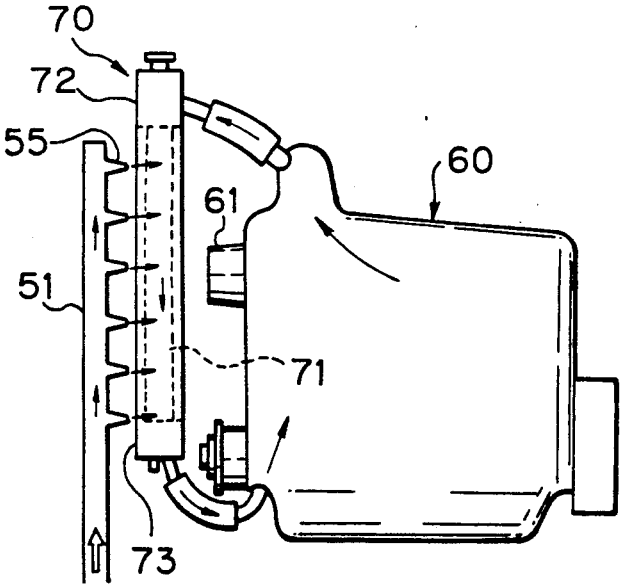
FIG. 5 is a schematic elevational view of a fourth embodiment of the invention.

FIG. 5 illustrates a fourth embodiment of the invention. In this radiator cooling apparatus, an air injection duct 51 is installed outside of the engine 60 with the radiator 70. On the active surface of the injection duct 51, a plurality of nozzles 55 are formed as shown in FIG. 3. It should be understood that, depending upon a designer's choice, the air injection duct can be positioned between the radiator and the engine housing (FIG. 3) or outside of the engine (FIG. 5).

A special advantage of the embodiment of FIG. 5 is that the airflow from nozzles 55 is also directed toward the engine housing, whereby additional cooling effects are given to the engine room, accessories, engine housing exhaust manifolds and so on.

Thus, as is apparent from the above description, the radiator cooling apparatus of the invention can provide technical advantages as follows:

(a) this invention can be applied to an existing engine and radiator system;

(b) The existing fan can be removed, whereby the fan noise is eliminated. The greatest part of the engine noise is transformed into the small noise of a closed-type blower;

(c) due to the removal of the fan, the total length of the engine is considerably lessened; and (d) since the suction duct and the injection duct can be installed at a desired position, flexibility is given in car design.

I claim:

1. A radiator cooling apparatus for an automobile engine, comprising:

a liquid cooled automobile engine;

a main radiator for cooling said automobile engine, having a core connected to said liquid cooled automobile engine by a first hose for delivery of hot liquid to said main radiator from said automobile engine and a second hose for return of liquid cooled by said main radiator to said automobile engine; and an air flow duct for flowing air through said main radiator, said air flow duct comprising a hollow rectangular body defined by opposite rectangular surfaces, one of said surfaces having a plurality of air conduits extending outwardly therefrom parallel to each other toward said core of said main radiator, said one of said surfaces facing said core of said main radiator closely adjacent thereto, and a blower enclosed within an air passage tube connected to the interior of said hollow rectangular body for blowing air through said tube such that air flows through said plurality of air conduits and thus through said core of said main radiator, said hollow rectangular body being substantially the same size as said main radiator.

2. The apparatus of claim 1, wherein said air conduits are nozzles tapering outwardly from said one of said surfaces toward said core of said main radiator, and said blower blows air out of said nozzles toward said core.

3. The apparatus of claim 2, wherein said main radiator is between said hollow rectangular body and said automobile engine such that air blows through said main radiator toward said engine.

4. The apparatus of claim 2, wherein said hollow rectangular body is between said engine and said main radiator.

5. The apparatus of claim 1, wherein said air conduits are bellmouths widening outwardly from said one of said surfaces toward said core of said main radiator, and said blower sucks air into said bellmouths, thus sucking air through said core:

6. The apparatus of claim 5, wherein said main radiator is between said hollow rectangular body and said automobile engine.

7. The apparatus of claim 5, wherein said hollow rectangular body is between said engine and said main radiator.

8. The apparatus of claim 1, wherein said blower is driven by an electric motor located inside said air passage tube.

9. The apparatus of claim 1, wherein said air conduits are distributed over said one of said surfaces in a uniform pattern.

* * * * *